US005711088A

United States Patent [19]

Lindqvist et al.

[11] Patent Number: 5,711,088

[45] Date of Patent: Jan. 27, 1998

[54] DEVICE FOR RECUDING THE EFFECTS OF THE TENDENCY OF A PAPER WEB TO ADHERE TO A DRYING CYLINDER IN A PAPERMAKING MACHINE

[75] Inventors: Niclas Lindqvist, Växjö; Claes Halldin, Gemla, both of Sweden

[73] Assignee: ABB Fläkt AB, Stockholm, Sweden

[21] Appl. No.: 765,195

[22] PCT Filed: Jun. 20, 1995

[86] PCT No.: PCT/SE95/00752

§ 371 Date: Jan. 28, 1997

§ 102(e) Date: Jan. 28, 1997

[87] PCT Pub. No.: WO96/01341

PCT Pub. Date: Jan. 18, 1996

[30] Foreign Application Priority Data

Jul. 4, 1994 [SE] Sweden ..... 9402346

[51] Int. Cl.[6] ..... D21G 5/00

[52] U.S. Cl. ..... 34/114; 34/117; 34/122; 34/130

[58] Field of Search ..... 34/114, 115, 116, 34/117, 119, 120, 122, 124, 130, 448, 452, 455; 239/533.3, 548, 557, 564; 162/360.3

[56] References Cited

U.S. PATENT DOCUMENTS

| | | | |
|---|---|---|---|
| 4,553,340 | 11/1985 | Petersson | 34/114 |
| 4,602,439 | 7/1986 | Eskelinen et al. | 34/116 X |
| 4,628,618 | 12/1986 | Virta et al. | 34/116 |
| 4,669,198 | 6/1987 | Wedel | 34/114 X |
| 4,923,567 | 5/1990 | Liedes et al. | 34/120 X |
| 4,932,138 | 6/1990 | Liedes et al. | 34/120 X |
| 5,475,934 | 12/1995 | Eskelinen et al. | 34/455 |
| 5,557,863 | 9/1996 | Kokkala | 34/455 X |

FOREIGN PATENT DOCUMENTS

| | | |
|---|---|---|
| 0 130 158 | 1/1985 | European Pat. Off. . |
| WO87/06283 | 10/1987 | WIPO . |

*Primary Examiner*—Henry A. Bennett
*Assistant Examiner*—Steve Gravini
*Attorney, Agent, or Firm*—Burns, Doane, Swecker & Mathis,L.L.P.

[57] ABSTRACT

A device is arranged in the drying section of a papermaking machine for reducing the effects of the tendency of a paper web (4) to adhere to a drying cylinder (1) as it passes from the drying cylinder to a subsequent guide roll (2). In the drying section, the paper web (4), supported by a drying fabric (5), is conducted alternatingly over a plurality of drying cylinders (1) and guide rolls (2). A blow box (6) is arranged in the transition portion (A) and has a wall (7) extending in parallel with the drying fabric (5) so as to form a narrow air gap (8) between the wall and the drying fabric. The blow box (6) comprises nozzle (12) having a slot-shaped opening for ejecting a well-defined air jet (P1) towards the drying fabric (5) away from the air gap (8). The nozzle (12) is directed such that its center plane intersects the circumferential surface of the drying cylinder (1) along a first straight line positioned upstream of a second line, along which the paper web (4) leaves the drying cylinder (1).

4 Claims, 4 Drawing Sheets

DEVICE FOR RECUDING THE EFFECTS OF THE TENDENCY OF A PAPER WEB TO ADHERE TO A DRYING CYLINDER IN A PAPERMAKING MACHINE

The present invention relates to a device in the drying section of a papermaking machine, which comprises a plurality of drying cylinders and guide rolls and through which a paper web, supported by a drying fabric, is conducted alternatingly over the drying cylinders and the guide rolls in such a manner that the drying fabric presses the paper web against the drying cylinders and is positioned between the paper web and the guide rolls, said device being adapted to reduce the effects of the tendency of the paper web to adhere to a drying cylinder as it passes from the drying cylinder to a subsequent guide roll and comprising a blow box, which has a wall arranged in the portion where the paper web and the drying fabric pass from the drying cylinder to the guide roll and which faces the drying fabric and extends substantially in parallel therewith to form a narrow air gap between the wall and the drying fabric, and a nozzle arranged at the wall end positioned upstream with respect to the direction of travel of the paper web and the drying fabric, said nozzle being adapted to eject air at high velocity towards the drying fabric away from the air gap.

In a papermaking machine with a drying section of the above-mentioned type, the paper web tends to adhere to the drying cylinders when passing to the following guide roll. If such adhesion occurs, the aerodynamic forces are allowed to act on the paper web via the drying fabric in a negative fashion. The negative effect of these forces is particularly obvious when the papermaking machine is operated at high speed, i.e. when the paper web and the drying fabric are passed through the drying section at high speed (above 1200 m/min). The adhesion tendency is at a maximum at the beginning of the drying section and decreases as the paper web dries, and is at a maximum when the paper web is thin and intended for manufacturing of low-grammage paper.

If the paper web adheres to a drying cylinder and then leaves the web and follows the drying cylinder a distance, before releasing it and being returned to the drying fabric, a blister arises between the paper web and the drying fabric. Between this blister and the space at the opposite side of the drying fabric, a communication of air occurs via the drying fabric. This communication of air forms a complex and unstable flow field which can increase the blister and cause the paper web to flap, which may induce folds or breaks in the paper web.

The object of the present invention is to provide a device which guides the aerodynamic forces in such a manner that their negative effect on the paper web is eliminated or at least reduced and, consequently, makes it possible to operate the papermaking machine at higher speed, and which besides is designed such that the action of the air, which is necessary for achieving the intended effect, can be reduced.

According to the present invention, this object is achieved by a device which is of the type mentioned by way of introduction and characterised in that the nozzle has a slot-shaped opening and is designed to eject a well-defined air jet directed along the centre plane of the opening, that the nozzle is directed such that its centre plane intersects the circumferential surface of the drying cylinder along a first straight line which is positioned upstream of a second straight line, along which the paper web leaves the drying cylinder, and that the centre plane of the opening of the nozzle and the tangent plane of the drying cylinder, said tangent plane extending through said firs% straight line, make an angle between themselves, which is 10°–20°, preferably 15°.

The distance between these two straight lines along the circumferential surface of the drying cylinder preferably is 30–50 mm.

The invention will now be described in more detail with reference to the accompanying drawings.

Figure 1:
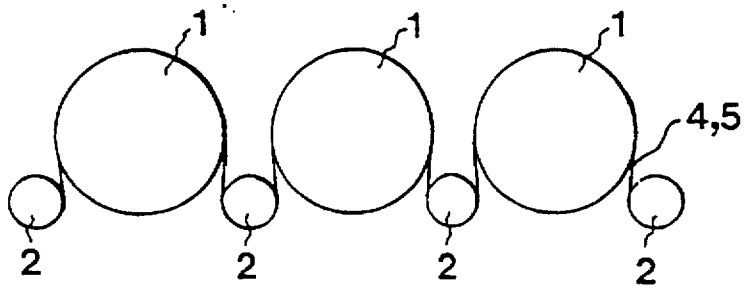
FIG. 1 is a schematic view of part of the drying section of a papermaking machine.

FIG. 1 shows part of the drying section of a papermaking machine, in which a plurality of steam-heated drying cylinders 1 and a plurality of perforated guide rolls 2 are arranged. The drying cylinders 1 are arranged in an upper horizontal row, and the guide rolls 2, whose diameter is considerably smaller than that of the drying cylinders 1, are arranged in a lower horizontal row. A guide roll 2 is arranged between the drying cylinders 1 in each pair of neighbouring drying cylinders. A delimiting unit 3 (FIG. 2) is fixedly arranged in the respective rotary guide roll 2. The delimiting unit 3 comprises a cylinder 3*a* with two radial flanges 3*b* whose outer ends sealingly engage the inner circumferential surface of the guide roll 2. The cylinder 3*a* of the delimiting unit 3 is perforated in that portion which is positioned under the two flanges 3*b*. A negative pressure is maintained in the cylinder 3*a* and, thus, in The lower part of the guide roll 2, that is delimited by the unit 3.

It is not essential to the invention that the drying section is designed in accordance with the example described above. For example, the guide rolls need not be of the type which uses an internal negative pressure.

A paper web 4 is conducted through the drying section to be dried. The paper web 4 is conducted in zigzag over the drying cylinders 1 and the guide rolls 2. The paper web 4 is supported by a permeable drying fabric 5, which consists of, for instance, a woven fabric and is arranged such that, at the drying cylinders, it is positioned outside the paper web 4 and presses it against the drying cylinders and, at the guide rolls 2, is positioned inside the paper web 4, i.e. between the paper web and the respective guide roll (see FIG. 2). The paper web 4 is sucked against the guide rolls 2 by the negative pressure maintained therein, which acts on the paper web 4 via the perforation of the guide rolls 2 and the permeable drying fabric 5.

Figure 2:
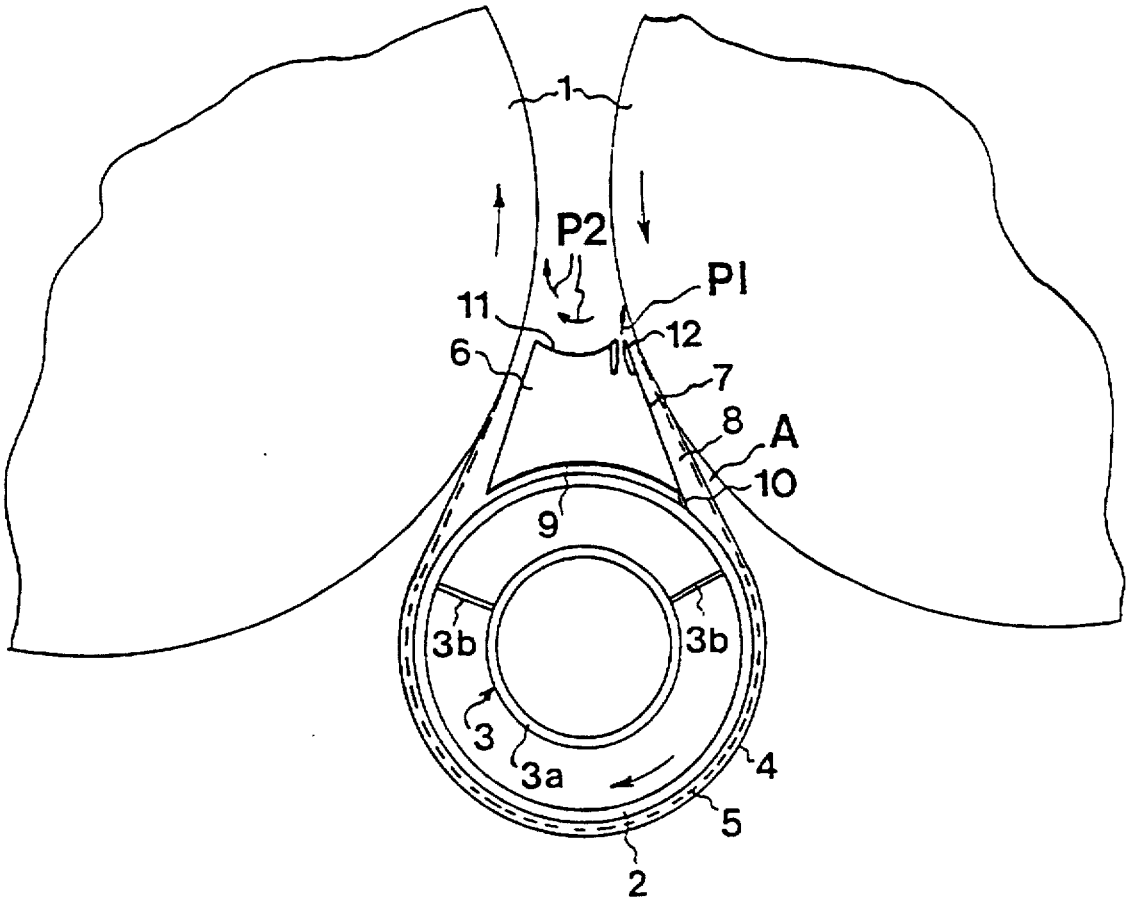
FIG. 2 illustrates a device according to the invention, mounted in the drying section of the papermaking machine.

As mentioned by way of introduction, the paper web 4 tends to adhere to the respective drying cylinder 1 when passing to the following guide roll 2, i.e. in that transition portion of the paper web 4 and the drying fabric 5 which in FIG. 2 is designated A.

To reduce the effects of the tendency of the paper web 4 to adhere to the drying cylinder 1 and, thus, to leave the drying fabric 5 and accompany the drying cylinder 1 a distance, before it releases the drying cylinder and is returned to the drying fabric 5, a blow box 6 is used, which is arranged above the guide roll 2 (FIG. 2). The blow box 6 extends over the entire axial length of the cylinders and rolls 1 and 2 and occupies, also in the lateral direction, essentially the entire space between the two consecutive drying cylinders 1. The blow box 6 has a side wall 7, which forms a mechanical shield at the transition portion A. The side wall 7 faces the drying fabric 5 and extends in parallel therewith, thereby forming a narrow air gap 8 between the side wall 7 and the drying fabric 5. The blow box 6 has a bottom 9 which extends along the upper portion of the guide roll 2 at a small distance from the circumferential surface of the guide roll. The side wall 7 has, at its lower end, a sealing lip 10 which sealingly engages the circumferential surface of the guide roll 2. The blow box 6 further has an upper wall 11. A nozzle 12, which has a longitudinal slot-shaped opening 13 and is arranged to eject air at high speed towards the drying fabric 5 away from the air gap 8, is arranged in the corner between the upper wall 11 and the side wall 7, the mouth of the slot-shaped opening 13 being positioned in the corner.

The ejected air flow (arrow P1), which produces a "peeling" of the air boundary layer that is entrained by the drying fabric 5, prevents the air entrained by the drying fabric 5 from being introduced into the air gap 8. The ejecting action of the ejected airflow and the air transport of the drying fabric 5 from the air gap 8 instead produce a negative pressure in the air gap. This negative pressure acts via the perforation of the drying fabric 5 on the paper web 4 and prevents the unstable airflow field as described above from forming in the transition portion A, which causes a reduction of the negative effect of the aerodynamic forces on the paper web.

Figure 3:
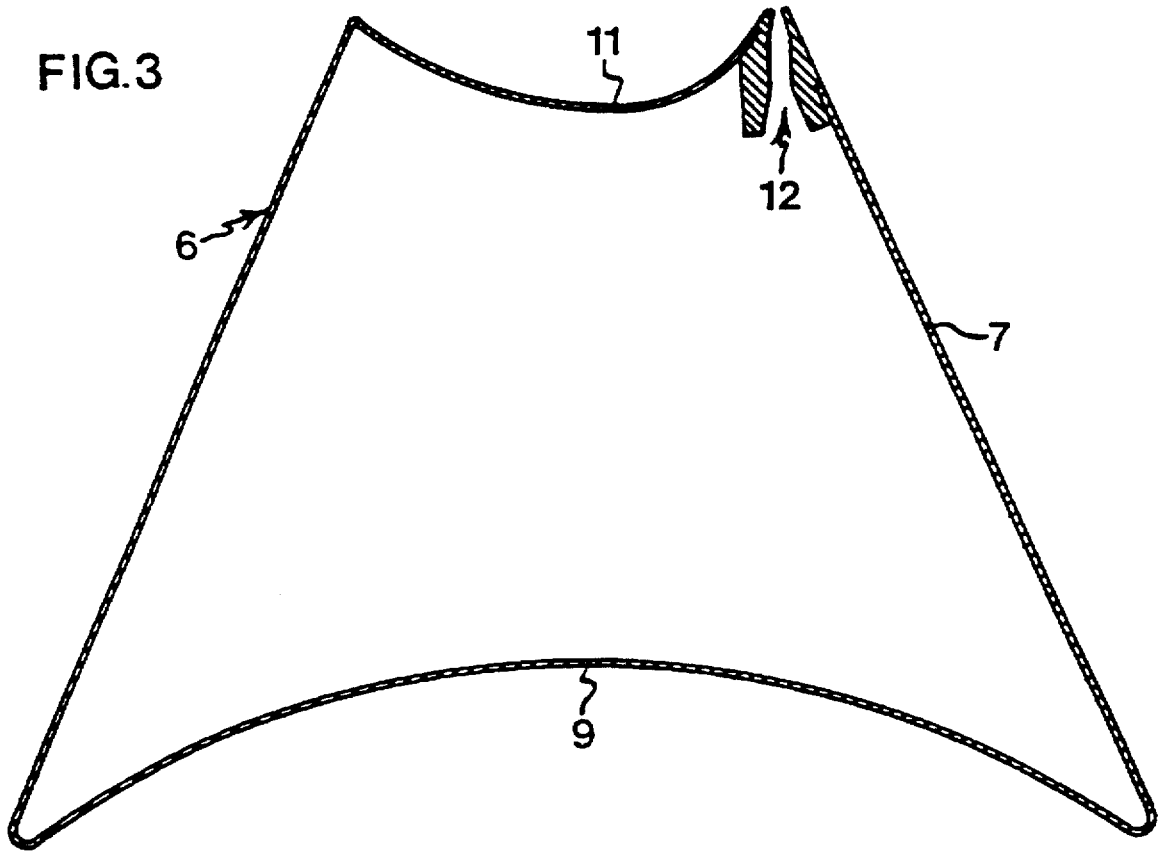
FIG. 3 illustrates a blow box included in the device.

The removal of the "peeled-off" airflow (arrows P2) from the space between the two consecutive drying cylinders 1 is facilitated by the upper wall 11 of the blow box 6 having an upwardly concave shape, as illustrated in FIGS. 2 and 3.

Figure 4:
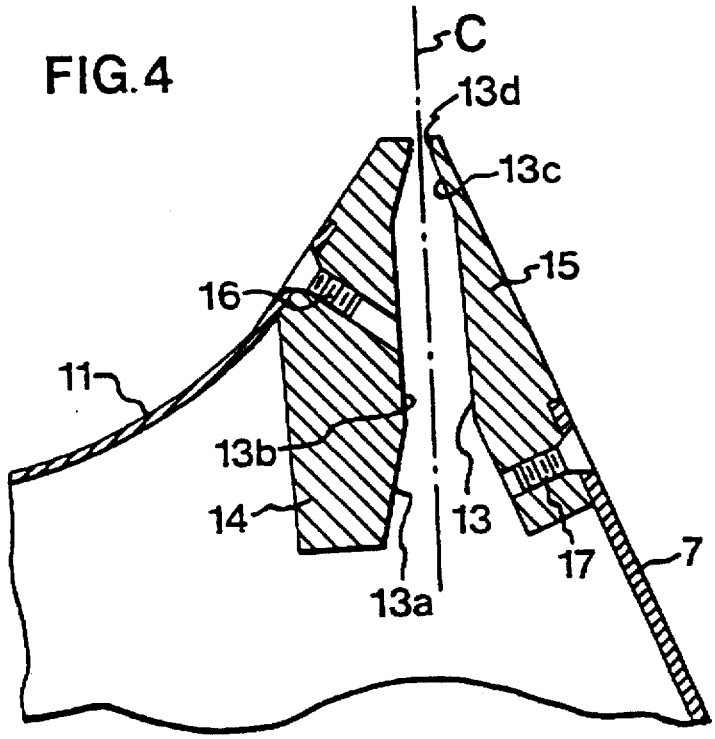
FIGS. 4–6 are cross-sectional views of a nozzle arranged in the blow box, in three different positions along the length of the blow box.

The nozzle 12 is composed of two straight metal strips 14 and 15, one 14 being attached to the lower side of the upper wall 11 by means of screws 16 (FIG. 4) and the other 15 being attached to the inside of the side wall 7 by means of screws 17 (FIG. 4). The screws 16 and 17 are uniformly distributed over the length of the strips 14 and 15.

The strips 14 and 15 form between themselves the longitudinal slot-shaped opening 13. This has a converging inlet portion **13*a* and a subsequent airflow-directing portion 13*b*, in which the side walls of the opening are parallel with each other and with the centre plane C of the opening (FIG. 4), which is positioned right between the side walls and in respect of which the opening 13 is symmetrical. The portion 13*b* of the slot-shaped opening 13 passes, via a converging portion 13*c*, into a short outlet portion or mouth portion 13*d*, in which its side walls are also parallel with the centre plane C. In the embodiment shown, the width of the slot at the wide end of the inlet portion 13*a* is 20 mm, at the narrow end of the inlet portion 13*a*, in the portion 13*b* and at the wide end of the converging portion 13*c* 10 mm, and at the narrow end of the converging portion 13*c* and in the outlet portion 13*d* 2.5 mm. In the embodiment illustrated, the length of the inlet portion 13*a* is 15 mm, the length of the straight portion 13*b* 28 mm, the length of the converging portion 13*c* 9.5 mm and the length of the outlet portion 13*d*** 2.5 mm.

The straight airflow-directing portion **13*b* of the slot-shaped opening 13 serves to produce a well-confined and well-defined air jet and therefore is of a length which is at least five times the width of the slot in the outlet portion 13*d*. With a well-defined air jet is here meant an air jet whose velocity along the centre plane C at a distance of about 10 times the width of said slot from the outlet of the nozzle is 0.68–0.78, especially 0.73, times the velocity of the air jet at the outlet. The length of the airflow-directing portion 13*b* can be reduced if a screen-like, airflow-directing insert is placed therein, having a plurality of through holes extending in parallel with the centre plane C of the slot-shaped opening 13**.

Figure 5:
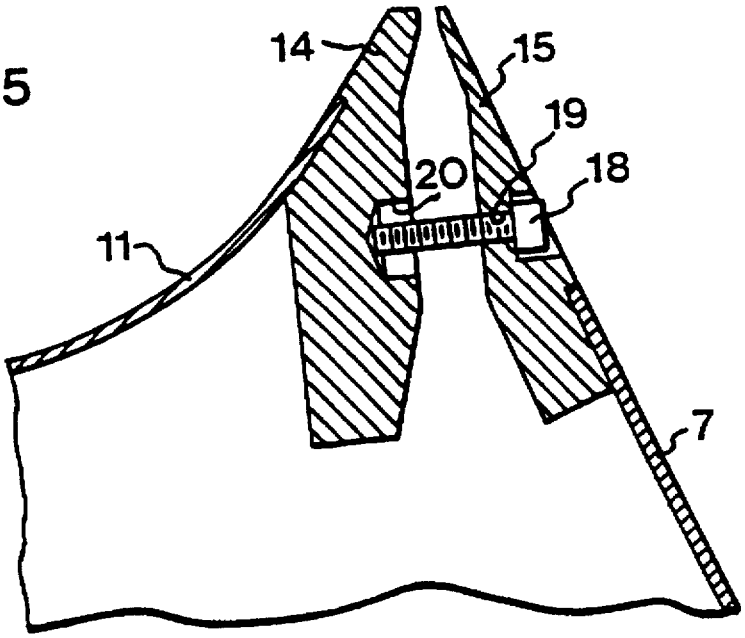

The two strips 14 and 15 are adjustable relative to one another by means of a plurality of screws 18 which are uniformly distributed over the length of the strips and of which one is shown in FIG. 5. Each screw 18 is fastened in a threaded hole 19 in the strip 15 attached to the side wall 7 and extends into a recess 20 in the strip 14 attached to the upper wall 11. When the end of the screw 18 abuts against the bottom of the recess 20 and the screw 18 is further screwed into the hole 19, the strips 14 and 15 and, thus, the walls 7 and 11 are pressed apart against the spring action of the walls.

Figure 6:
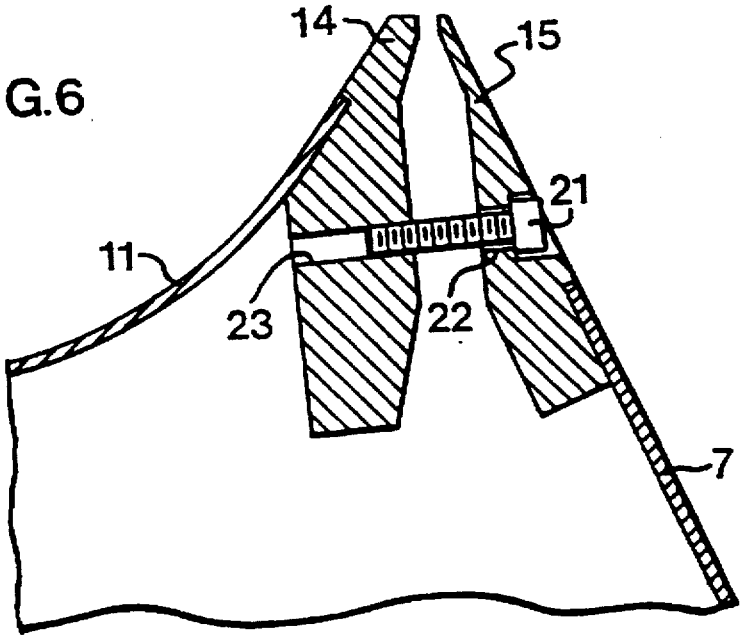

The strips 14 and 15 are fixed in the set position by means of a plurality of screws 21, which are uniformly distributed over the length of the strips and of which one is shown in FIG. 6. Each screw 21 extends through a clearance hole 22 in the strip 15 attached to the side wall 7 and is fastened in a threaded hole 23 in the strip 14 attached to the upper wall 11. The head of the screw 21 abuts against the outside of the strip 15.

The described arrangement of the adjusting and fixing screws 18 and 21 renders it possible to achieve, within certain limits, various settings throughout the length of the nozzle 12, for example by providing a wider slot-shaped opening 13 at the end walls of the blow box 6.

Figure 7:
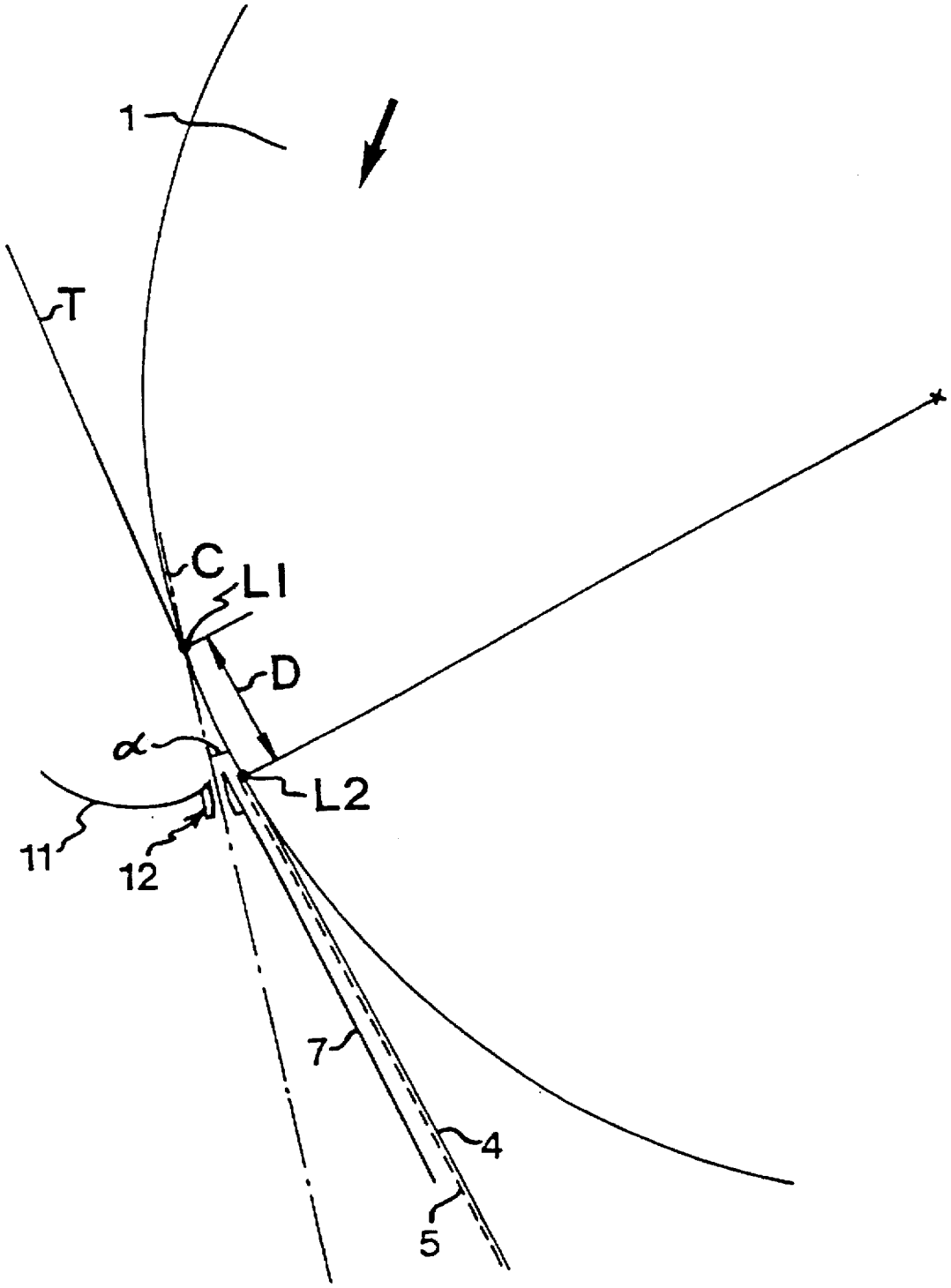
FIG. 7 illustrates the geometric conditions in the portion in which an air jet ejected by the nozzle strikes a drying cylinder.

The nozzle 12 is directed (see FIG. 7) such that its centre plane C intersects the circumferential surface of the drying cylinder 1 along a straight line L1, which is positioned upstream of the straight line L2, along which the paper web 4 leaves the drying cylinder 1. As will be appreciated, the two straight lines L1 and L2 are perpendicular to the plane of the drawing in FIG. 7. The distance D between the straight lines L1 and L2 along the circumferential surface of the drying cylinder 1 is 30–50 mm. Since the drying cylinder 1 normally is of a diameter of about 1500–about 1800 mm, the arc-chaped part of the circumferential surface of the drying cylinder 1, which extends between the straight lines L1 and L2, as shown in FIG. 7, can be approximated to a planar surface. The centre plane C and the tangent plane T of the drying cylinder 1, said tangent plane extending through the straight line L1, make an angle $\alpha$ between themselves, which is 10°–20°, preferably 15°.

We claim:

1. A device in the drying section of a papermaking machine, which comprises a plurality of drying cylinders (1) and guide rolls (2) and through which a paper web (4), supported by a drying fabric (5), is conducted alternatingly over the drying cylinders (1) and the guide rolls (2) in such a manner that said drying fabric (5) presses the paper web against the drying cylinders and is positioned between the paper web and the guide rolls, said device being adapted to reduce the effects of the tendency of the paper web (4) to adhere to a drying cylinder (1) as it passes from the drying cylinder to a subsequent guide roll (2) and comprising a blow box (6) having a wall (7) arranged in the portion (A) where the paper web (4) and the drying fabric (5) pass from drying cylinder (1) to the guide roll (2), said wall facing the drying fabric (5) and extending substantially in parallel therewith so as to form a narrow air gap (8) between the wall and the drying fabric, and a nozzle (12) arranged at the end of the wall (7), which is positioned upstream with respect to the direction of travel of the paper web (4) and the drying fabric (5), said nozzle being adapted to eject air at high velocity towards the drying fabric (5) away from the air gap (8), characterised in that said nozzle (12) has a slot-shaped opening (13) and is designed to produce a well-defined air jet (P1) directed along the centre plane (C) of said opening, that said nozzle (12) is directed such that its centre plane (C)

intersects the circumferential surface of said drying cylinder (2) along a first straight line (L1) which is positioned upstream of a second straight line (L2), along which said paper web (4) leaves the drying cylinder (1), and that the centre plane of said nozzle opening (13) and the tangent plane (T) of the drying cylinder (1), said tangent plane extending through said first straight line (L1), make an angle (α) between themselves, which is 10°–20°.

2. The device as claimed in claim 1, characterised in that said angle (α) is 15°.

3. The device as claimed in claim 1, characterised in that the distance between said straight lines (L1, L2) along the circumferential surface of the drying cylinder is 30–50 mm.

4. The device as claimed in claim 2, characterized in that the distance between said straight lines (L1, L2) along the circumferential surface of the drying cylinder is 30–50 mm.

* * * * *